United States Patent [19]

Morrison

[11] 3,959,556

[45] May 25, 1976

[54] ANTIMICROBIAL BLENDED YARNS AND FABRICS COMPRISED OF NATURALLY OCCURRING FIBERS

[76] Inventor: Willard L. Morrison, 1896 Meadowbrook Drive, Winston-Salem, N.C. 27104

[22] Filed: July 2, 1974

[21] Appl. No.: 485,207

Related U.S. Application Data

[60] Continuation-in-part of Ser. No. 349,798, April 10, 1973, abandoned, which is a continuation-in-part of Ser. No. 330,458, Feb. 7, 1973, abandoned, which is a division of Ser. No. 143,634, May 14, 1972, abandoned, which is a continuation-in-part of Ser. No. 754,075, Sept. 20, 1968, abandoned.

[52] U.S. Cl. ..... 428/364; 57/140 BY; 428/365; 428/393; 428/394; 428/395; 428/907

[51] Int. Cl.[2] ..... B32B 27/00; D02G 3/00

[58] Field of Search..... 161/172, 176; 57/140 R, 57/140 BY, 153, 157 R; 117/138.8 N; 106/15 AF; 428/364, 365, 392, 394, 395, 907, 393

[56] References Cited

UNITED STATES PATENTS

| | | | |
|---|---|---|---|
| 2,483,405 | 10/1949 | Francis | 161/150 X |
| 2,919,200 | 12/1959 | Dubin et al. | 106/15 AF |
| 3,282,877 | 11/1966 | Lowes, Jr. | 57/140 UX |
| 3,287,210 | 11/1966 | Leebrick | 106/15 AF |
| 3,296,000 | 1/1967 | Bockno et al. | 57/140 UX |
| 3,308,488 | 3/1967 | Schoonman | 106/15 AF |
| 3,345,341 | 10/1967 | Berry et al. | 117/138.8 N |

*Primary Examiner*—Lorraine T. Kendell

[57] ABSTRACT

Antimicrobial properties are imparted to naturally occurring fibers, such as cotton fibers and fabrics, by intimately admixing the naturally occurring fibers with synthetic fibers prepared by extruding a spinnable solution of a synthetic thermoplastic resin and at least 0.1% by weight of an antimicrobial agent into a strand having a denier of 1.5–60 dpf. The synthetic fibers are characterized by the antimicrobial agent therein migrating to the fiber surface to form a coating thereon and then transferring to the naturally occurring fibers by physical contact as the amount of antimicrobial agent on the surface of the naturally occurring fibers diminishes. Additional antimicrobial agent then migrates to the surface of the synthetic fiber until equilibrium is re-established.

2 Claims, No Drawings

ANTIMICROBIAL BLENDED YARNS AND FABRICS COMPRISED OF NATURALLY OCCURRING FIBERS

REFERENCE TO RELATED APPLICATION

This application is a continuation-in-part of co-pending application Ser. No. 349,798 filed Apr. 10, 1973, now abandoned, which is a continuation-in-part of application Ser. No. 330,458, filed Feb. 7, 1973, now abandoned, which is a division of application of Ser. No. 143,634, filed May 14, 1972, now abandoned, which in turn is a continuation-in-part of Ser. No. 754,075, filed Aug. 20, 1968, now abandoned.

BACKGROUND OF THE INVENTION

Naturally occurring fibers, such as cellulose fibers, e.g., cotton and flax; wool; and the like possess properties such as moisture absorption, which renders them superior in many respects to synthetic fibers. For this reason, these fibers, and particularly cotton fibers, are commonly used in preparing garments which come into contact with the human skin, such as underwear and socks. A problem is presented in the wearing of such garments, however, since the warmth and moisture of the human skin causes rapid growth of bacteria and fungus on the fibers forming these garments leading to the generation of body odors and possible infections.

To overcome this problem, the prior art has described treating of naturally occurring fibers, such as cotton fibers, with various antimicrobial agents to inhibit the growth of bacteria and fungus. Because of the fact that the fibers are naturally occurring, such treatment can only be a surface treatment whereby the antimicrobial agent is applied to the fibers by padding or dipping of the fabric, or the like. While a treatment of this nature temporarily inhibits bacterial and fungal growth, the antimicrobial agent is removed from the surface of the fibers after a limited period of time as a result of wearing of the garments and particularly during laundering. To date, no means has been proposed whereby antimicrobial properties could be more permanently imparted to naturally occurring fibers so that the fibers would possess antimicrobial properties over the life of the garment into which they are incorporated.

SUMMARY OF THE INVENTION

It is an object of the present invention to provide yarns comprised of naturally occurring fibers which more permanently possess antimicrobial properties.

It is another object of the present invention to provide fabrics and garments comprised of yarns which contain naturally occurring fibers possessing antibacterial and fungicidal properties over the period of usefulness of the fabric or garment.

It is another object of the present invention to provide a method for imparting antibacterial and fungicidal properties of increased permanency to naturally occurring fibers and yarns containing such fibers.

Other objects of the present invention, if not specifically set forth herein, will be obvious to the skilled artisan from a reading of the detailed description which follows:

DETAILED DESCRIPTION

U.S. Pat. Nos. 2,919,200 and 3,308,488 to Dubin et al and Schoonman, respectively, describe improved plastic compositions possessing antimicrobial properties which are formed by heating a mixture of a thermoplastic resin and an antimicrobial agent to a temperature above that of both the resin and the agent. By employing this technique, it is disclosed that the antimicrobial agent distributed within the plastic has the inherent property of migrating to the surface of shaped articles formed from the plastic to provide a surface coating of antimicrobial agent. Most importantly, it is also disclosed that removal of this surface coating will result in additional antimicrobial agent migrating from the interior of the molded article to replenish the surface coating.

In the present invention, it has been discovered that the aforesaid property can be utilized to effectively impart antimicrobial properties of a more permanent nature to naturally occurring fibers by combining the naturally occurring fibers in intimate relationship with fibers prepared from plastics of the type disclosed in the aforesaid patents. Surprisingly, it has been discovered that the intimate contact of the naturally occurring fibers with the synthetic fibers results in sufficient antimicrobial agent being transferred to the naturally occurring fibers from the synthetic fibers to prevent bacterial and fungal growth on natural fibers. Furthermore, as the antimicrobial agent is removed from the naturally occurring fibers during laundering and the like, it is replenished from within the interior of the synthetic fibers. Thus, a means is provided for replenishing the coating of antimicrobial agent on naturally occurring fibers in garments containing such fibers to provide continuous protection in spite of the fact that such garments are subjected to wearing, laundering and the like.

As used herein, the term "antimicrobial agent" is intended to include both fungicidal and antibacterial agents, the latter functioning as either a bacteriostatic or bactericidal agent.

It is recognized that prior art disclosures, such as U.S. Pat. No. 3,296,000 to Bockno et al, have taught the incorporation of antibacterial agents into synthetic fibers which may be subsequently blended with other fibers. On such instances, however, the antibacterial agent only inhibits bacterial growth on the fiber into which it is incorporated and does not serve the additional function, as in the present invention, of inhibiting such growth on the other fibers by transfer onto the surface thereof, this property being unique to the compositions utilized herein which possess the ability to replenish the antimicrobial coating from within the synthetic fibers.

In preparing the products of the present invention, a synthetic thermoplastic resin, in particularly a resin selected from the group consisting of the polyamides, such as nylon 4 (sold under trademark Tajmir by Alrac Corp., Stamford, Conn.), nylon 6, nylon 66; acrylics, modacrylics, saran (80% vinylidene chloride), vinyon, (comonomer containing 85% vinyl chloride) vinyl, polyvinylchloride, a vinyon/vinal (textile fiber made from polyvinyl alcohol) copolymer such as Cordelan (registered trademark of Kohjin Co., Tokyo, Japan), and the polyolefins, particularly polypropylene and polyethylene, is intimately admixed in either the dry or molten state or in a spinnable solution with a small amount of an antimicrobial agent. The mixture of resin and agent is then, in the case of those admixed in the molten state, heated to a temperature above the melting point of both the resin and the agent, but below the decomposition temperature of the antimicrobial agent. In both cases the mixture is then extruded or otherwise formed into fibers desirably having a denier per filament of from about 1½ to about 60 and preferably from about 1½ to about 40.

Instead of the above techniques, fibers may also be formed by other prior art techniques, such as extruding a film of resin containing the antimicrobial agent, and thereafter fibrilating the film by known procedures.

The resultant filaments, in one embodiment, which may be chopped into short fiber lengths e.g., of from about 1 inch to about 3 inches, and preferably about 1½ inches, are then intimately admixed, e.g., by blending, with naturally occuring fibers, such as cotton fibers, at any stage of the yarn forming process according to known techniques. This yarn may be used in the formation of fabrics and garments by weaving, knitting, or the like. Fibers of the antimicrobially treated synthetic material may also be admixed with naturally occurring fibers such as cellulose in non-woven techniques. Alternatively, the synthetic filaments or yarns and naturally occurring fibers or yarns may be intimately admixed in other ways, e.g., by twisting two or more yarn ends, core spinning, Bob-Tex method, using a warp of one type and a weft of the other, or the like.

More specifically, one of the thermoplastic resins, described hereinabove, such as polypropylene, is intimately admixed in a molten state with at least 0.% of an antimicrobial agent of the type to be further described hereinafter and then extruded through a conventional spinnerette to form filaments of a desired denier in the aforesaid range. When making disposable articles which are used only a few times, from about 0.1% to about 0.5% antimicrobial agent is generally adequate. Preferably, however, and particularly when the yarn is to be used in making more permanent articles, up to about 1.5% of the antibacterial agent is used. These filaments are then cut into lengths of approximately 1½ inch and the fibers intimately blended with cotton fibers in a conventional manner and formed into a yarn.

In yarns prepared in this manner, it is observed that the antimicrobial agent within the synthetic fiber migrates to the surface of the synthetic fiber until surface saturation and equilibrium is reached to form a coating thereon. Because of the intimate contract of the synthetic fibers with the naturally occurring fibers along a substantial surface area, this coating is physically transferred to the naturally occurring fibers in a sufficient amount to impart antimicrobial properties thereto. This transfer is significantly enhanced by the presence of moisture such as naturally occurring humidity or perspiration and thus results in a greater transfer of antibacterial agent at the time that it is required, e.g., when a garment formed from such yarns is being worn. This transfer is further enhanced by the natural wicking action of the naturally occurring fibers in the presence of moisture. Removal of the antimicrobial agent from the surface of the naturally occurring fibers and synthetic fibers, e.g., through laundering, results in a disturbance of the equilibrium causing additional antimicrobial agent to migrate from the interior of the synthetic fibers to the surface thereof which then transfers, as previously described, to the naturally occurring fibers, thus maintaining the antibacterial properties of these latter fibers. In this manner, continuing antimicrobial properties are imparted until the reservoir of antimicrobial agent originally placed in solution within the resin of the synthetic fiber has been exhausted.

The antimicrobial agents, usable in the present invention may, for example, be of the type employed in the aforesaid Dubin et al and Schoonman patents, specifically antibacterial agents having a decomposition temperature above the molding or extrusion temperature of the thermoplastic resin and being characterized by an ability to be used with relative safety in contact with human skin and to kill disease-producing micro-organisms including germs, bacteria and fungi. Specifically, the antibacterial agents disclosed by Dubin et al, i.e., 2,2′-thiobis (4,6- dichlorophenol) and 2,2′-methylenebis-(3,4,6-trichloro) phenol, may be employed. Even more preferably, because of its overall properties, the antibacterial agent employed is 2,4,4′trichloro -2′-hydroxydiphenyl ether. Other antibacterial or fungicidal agents possessing the aforesaid properties may also be used and include nitrophenylacetate, phenylhydrazine, and polybrominated salicylanilides, such as 5,4′-dibromosalicylanilide and 3,5,4′-tribromosalicylanilides.

The amount of synthetic fiber incorporated into the fiber blend necessary to impart antimicrobial properties to the naturally occurring fibers will depend upon other variables such as the denier and the percent of antimicrobial agent in the fibers. Generally, however, at least 20% of the blended yarn should be composed of the synthetic fibers if substantially complete inhibition is desired, and preferably the yarn should contain from about 35 to about 65% of the synthetic fiber. Some inhibition is observable in using as little as 10% synthetic fiber. Greater percentages of the synthetic fibers may, of course, be employed for reasons unrelated to imparting antibacterial properties to the naturally occurring fibers, if desired. As a specific example, polypropylene/cotton blended yarn should contain the polypropylene and cotton fibers in a ratio of at least 25/75, and preferably the fibers should be present in a ratio of about 35/65 to about 65/35.

In addition to utilizing the present yarns in underwear and socks, these yarns are also useful in inhibiting bacterial and fungal growth in other fabric products including, but not limited to bed linens, blankets, mattress and pillow tickings, rugs, shoe inner linings, shower curtains, sanitary napkins and diapers.

The following examples are presented as illustrative of the present inventions and not in limitation thereof. Other synthetic resins, such as acrylic, may be substituted for the polypropylene with like results.

EXAMPLE I

A yarn was formed from polypropylene containing 1% by weight 2,2′-methylenebis-(#,4,6-trichloro) phenol, by heating the mixture to above the melting points of both components and extruding filaments which were chopped into staple and blended with combed cotton to form a 65/35 blend of the polypropylene fibers and cotton respectively. An athletic sock was knitted using the polypropylene/cotton blend, plus additonal nylon to obtain a 59/32/9 construction of the polypropylene/cotton/nylon blend.

All samples were laundered in a Sears Kenmore Automatic washer, Model 20500 Series, having a delicate wash cycle, and using hot wash water (145°F) with one-third cup of liquid cold water ALL detergent. After a wash cycle of 9 minutes using the delicate wash setting, the samples were subject to the standard spin, cold water rinse and spin-dry cycles. The entire sample was dried in a Sears Automatic Clothes Dryer, Model 60210-70210 Series, at 160°F., after which samples were cut for testing for zones of inhibition.

Test samples in the form of a 19mm disc were cut from the sock after a designated number of washings. The test samples had a tendency to curl up and away from the test surface, therefore, to maintain uniform contact therebetween, a disc-shaped, rust-proof brass member having a diameter of about 18mm was placed on top of the test sample.

Testing was performed according to the Bauer-Kirby test disclosed in the article by Bauer, Kirby, Sherriss, and Turck, *American Journal of Clinical Pathology*, Vol. 45, No. 4, 1966. In this test, a nutrient agar is used rather than the Mueller-Hinton agar because of the propensity of antibacterial agent to combine with components of the Mueller-Hilton agar. The nutrient agar plates (15 ml agar) were streaked with a cotton swab which was dipped into the broth inoculum and wrung on the sides of the container to remove excess broth. Streaking was made in at least three directions on the plates to cover the entire plate area. The zone of inhibition is measured in mm's to give a radial zone extending outwardly from the test disc by: measuring the total diameter of the halo, including the test disc, substracting the diameter of the test disc and dividing the remainder by 2.

The results of the sock-wash-study are summarized in Table 1.

TABLE 1

| WASHING | Zone (mm) |
|---|---|
| None | 2.4**** |
| 1 | 5 |
| 2 | 3.7 |
| 3 | 5.4 |
| 4 | **12 |
| 5 | **12 |
| 6 | 7 |
| 7 | **12 |
| 8 | 7 |
| 9 | 6 |
| 10 | 6 |
| 11 | 8 |
| 12 | 9 |
| 13 | 3.4 |
| 14 | 3.6 |
| 15 | 8.5 |
| 16 | 4.3 |
| 17–20 | * |

TABLE 1-continued

| WASHING | Zone (mm) |
|---|---|
| 21 | 5 |
| 22 | 4 |
| 23 | 4.4 |
| 24,25,26,27,28*** | |

* No measurable zone established, although "fingers of antibacterial inhibition" were evident, and subcultures made from underneath the test sample gave no growth therefrom, indicating death of the bacteria at the sites of contact with the test sample.

** Indicates that for some reason there is more bacteriostatic agent in these particular samples than on other; perhaps a clump of agent has formed in sample. In any case these results are not consistent with the rest of the test and should probably be disregarded to interpret the entire test.

*** Zones for samples 24–28 were immeasurable, however, "fingers of antibacterial inhibition" were evident, and subcultures made from beneath the test samples gave no growth therefrom. This would indicate death of the bacteria at the sites of contact with the test samples, even though no surrounding zone was evident.

****Surface treatment finish given to yarns, for purposes of processing probably cause an initial inhibition of maximum capability. This is removed by the first washing.

It will be apparent to the skilled artisan that the foregoing description is intended to be of an illustrative nature and that many modifications and variations thereof can be made without departing from the spirit and scope of the invention.

What is claimed is:

1. Improved composite antimicrobial yarns comprising an intimate admixture of naturally occurring fibers and synthetic fibers, said synthetic fibers selected from the group of fiber forming polymers consisting of polyolefins, modacrylics, nylon 4, nylon 6, nylon 66 and having incorporated therein at least 0.1% by weight of the resin an antimicrobial agent selected from the group consisting of 2,4,4′-trichloro-2′-hydroxydiphenyl ether; 2,2′-methylenebis- (3,4,6-trichlorophenol); and 2,2′-thiobis (4,6-dichlorophenol), wherein said agent is mixed with said fiber forming polymer in the molten state, said synthetic fibers having a denier in the range of 1.5–60 dpf and being admixed with said naturally occurring fibers in a weight to weight ratio of from 35/65 to 65/35, said composite yarns being characterized by said antimicrobial agent migrating to the surface of said synthetic fibers and then transferring to the entire surface of said naturally occurring fibers to impart antibacterial properties thereto.

2. The yarns according to claim 1 wherein said composite yarns comprise a blend of said naturally occurring fibers and said synthetic fibers.

* * * * *